US007975503B2

(12) United States Patent
Lim et al.

(10) Patent No.: US 7,975,503 B2
(45) Date of Patent: Jul. 12, 2011

(54) ICE MAKING DEVICE AND REFRIGERATOR HAVING THE SAME

(75) Inventors: Jae Hoon Lim, Suwon-Si (KR); Dong Nyeol Ryu, Daedeok-gu (KR); Jong Dal Lee, Gwangsan-gu (KR); Ji Hoon Kim, Jeju-si (KR); Myung Hoon Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 243 days.

(21) Appl. No.: 12/005,357

(22) Filed: Dec. 27, 2007

(65) Prior Publication Data

US 2008/0173040 A1 Jul. 24, 2008

(30) Foreign Application Priority Data

Jan. 19, 2007 (KR) ..... 10-2007-0006258

(51) Int. Cl.
*F25C 1/14* (2006.01)
*F25C 1/00* (2006.01)

(52) U.S. Cl. ..... 62/354; 62/353

(58) Field of Classification Search ..... 62/353, 62/354, 340

See application file for complete search history.

(56) References Cited

U.S. PATENT DOCUMENTS

| | | | | |
|---|---|---|---|---|
| 3,276,225 | A * | 10/1966 | Linstromberg | 62/353 |
| 4,706,465 | A * | 11/1987 | Searl | 62/137 |
| 4,838,026 | A * | 6/1989 | Searl | 62/137 |
| 6,952,936 | B2 | 10/2005 | Sannasi et al. | |
| 2005/0072166 | A1 * | 4/2005 | Lee et al. | 62/135 |
| 2006/0090485 | A1 * | 5/2006 | Lee et al. | 62/135 |
| 2006/0117786 | A1 | 6/2006 | Lee et al. | |

FOREIGN PATENT DOCUMENTS

KR 2005-110330 11/2005

* cited by examiner

*Primary Examiner* — Frantz F Jules
*Assistant Examiner* — Cassey Bauer
(74) *Attorney, Agent, or Firm* — Staas & Halsey LLP

(57) ABSTRACT

A refrigerator includes a main body which forms an external appearance and has a storage chamber to be opened at a front side, and an ice making device which is disposed in the storage chamber to make ice. The ice making device includes an ice making tray which has ice making grooves for making ice, an ejector which rotates and separates the ice made in the ice making grooves, blocking members which are disposed at an upper portion of one side of the ice making grooves to prevent the ice separated from the ice making grooves through the other side of the ice making grooves from returning to the ice making grooves, and a guide member which is disposed above the other side of the ice making tray to guide the ice separated from the other side of the ice making grooves by the ejector toward the blocking members.

9 Claims, 5 Drawing Sheets

ICE MAKING DEVICE AND REFRIGERATOR HAVING THE SAME

CROSS-REFERENCE TO RELATED APPLICATIONS

This application claims the benefit of Korean Patent Application No. 2007-0006258, filed on Jan. 19, 2007 in the Korean Intellectual Property Office, the disclosure of which is incorporated herein by reference.

BACKGROUND

1. Field

The present invention relates to a refrigerator having an ice making device, and, more particularly, to a refrigerator having an ice making device which separates ice from ice making grooves by an ejector.

2. Description of the Related Art

Generally, a refrigerator including components for a cooling cycle is an apparatus which stores storage products while cooling or freezing them by cool air generated through the components for a cooling cycle. For example, there is a refrigerator as disclosed in Korean Patent Laid-open Publication No. 2005-110330, which includes an ice making device which makes ice in a storage chamber and an ice supplying device which supplies the ice made by the ice making device to the outside such that the ice can be automatically made and supplied.

The ice making device includes an ice making tray which has ice making grooves for making ice, and an ejector which is rotatably installed and separates the ice made in the ice making grooves by rotation. The ice making device further includes a driving motor which generates a rotational force to rotate the ejector, and a driving case which is disposed at the front side of the ice making tray to have the driving motor therein. The ice making device further includes a fixing bracket which is installed on an upper surface of the storage chamber, wherein the ice making tray and the driving case are disposed under the fixing bracket, such that the ice making tray and the driving case can be installed while hanging from the upper surface of the storage chamber.

However, in the ice making device, the ice which moves upward from the ice making tray by the ejector and is separated from the ice making grooves may be inserted between the ejector and the fixing bracket. Particularly, when a distance between a lower surface of the fixing bracket and an upper surface of the ice making tray is formed to be small in order to provide a compact ice making device, the ice may be more frequently inserted therebetween. As mentioned above, when the ice is inserted between the ejector and the fixing bracket, there is a problem such that the ice making device is not operated since the rotation of the ejector is interrupted by the ice.

SUMMARY

The present invention has been made in order to solve the above problems. It is an aspect of the invention to provide a refrigerator to prevent ice separated from ice making grooves by an ejector from being inserted between a lower surface of a fixing bracket and the ejector.

In accordance with an aspect of the invention, a refrigerator comprises: a main body which forms an external appearance and has a storage chamber to be opened at a front side; and an ice making device which is disposed in the storage chamber to make ice, the ice making device including an ice making tray which has ice making grooves for making ice, an ejector which rotates and separates the ice made in the ice making grooves, blocking members which are disposed at an upper portion of one side of the ice making grooves to prevent the ice separated from the ice making grooves through the other side of the ice making grooves from returning to the ice making grooves, and a guide member which is disposed above the other side of the ice making tray to guide the ice separated from the other side of the ice making grooves by the ejector toward the blocking members.

Generally, the ice making device further includes a fixing bracket with the ice making tray installed under the fixing bracket such that the ice making tray is installed while hanging from an upper surface of the storage chamber of the refrigerator, and the guide member is formed at a lower portion of the fixing bracket as a single body with the fixing bracket.

Generally, the guide member is formed as a single body with an inner surface of the storage chamber.

In general, the guide member is formed outward in a radial direction of the ejector such that the guide member has a convex arc-shaped cross-section.

In accordance with another aspect of the invention, an ice making device comprises: an ice making tray which has ice making grooves for making ice; an ejector which rotates and separates the ice made in the ice making grooves; blocking members which are disposed at one side of the ice making tray to prevent the ice separated from the ice making grooves from returning to the ice making grooves; and a guide member which is disposed above the other side of the ice making tray to guide the ice separated from the other side of the ice making grooves by the ejector toward the blocking members.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
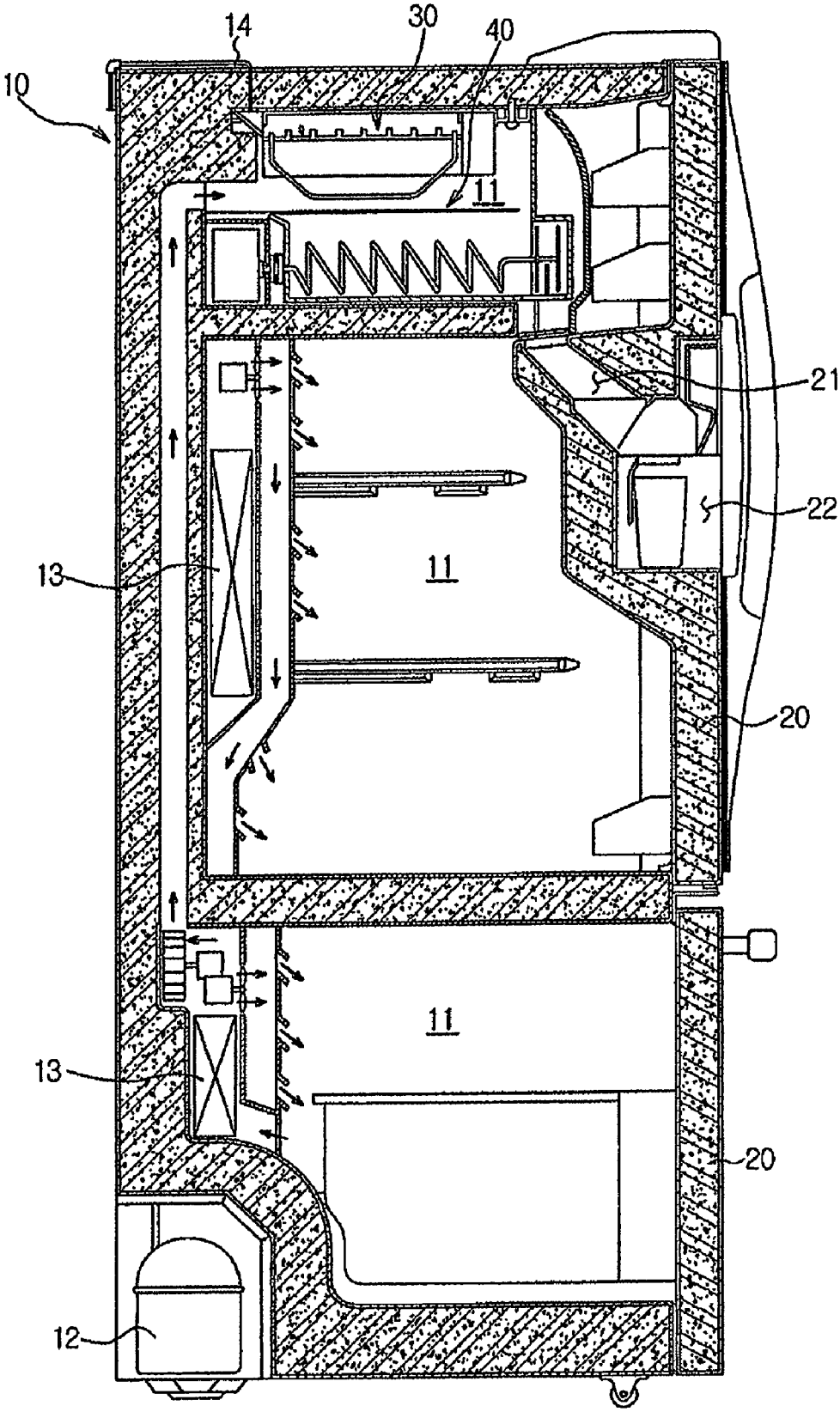
FIG. 1 illustrates a cross-sectional view showing a schematic configuration of a refrigerator having an ice making device according to an embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, an embodiment according to the present invention will be described in detail with reference to the accompanying drawings.

As shown in FIG. 1, a refrigerator according to the present invention includes a main body 10 which forms an external appearance and has a number of storage chambers to store food and the like therein, and a number of doors 20 which are hinge-coupled to one side of the main body 10 and are rotated to open and close storage chambers 11. Components for a cooling cycle such as a compressor 12, a condenser (not shown), an evaporator 13 and an expansion valve (not shown) are installed in the main body 10 to generate cool air. The inside of the storage chambers 11 may be cooled down through the cool air generated by the components for a cooling cycle.

Further, in the refrigerator according to the present invention, an ice making device 30 for making ice is installed at an upper portion of any one of the storage chambers 11. An ice supplying device 40 is disposed under the ice making device 30 to store the ice and discharge the ice to the outside when necessary. A discharge guide line 21 is disposed in any one of the doors 20 to communicate with the inside of the storage chamber 11 and guide the discharge of the ice such that a user can take out the ice made in the ice making device 30 without opening the door 20. An ice discharging part 22 is formed on the front surface of the door 20 to be depressed inward such that the user can easily receive the ice discharged through the discharge guide line 21.

Figure 2:
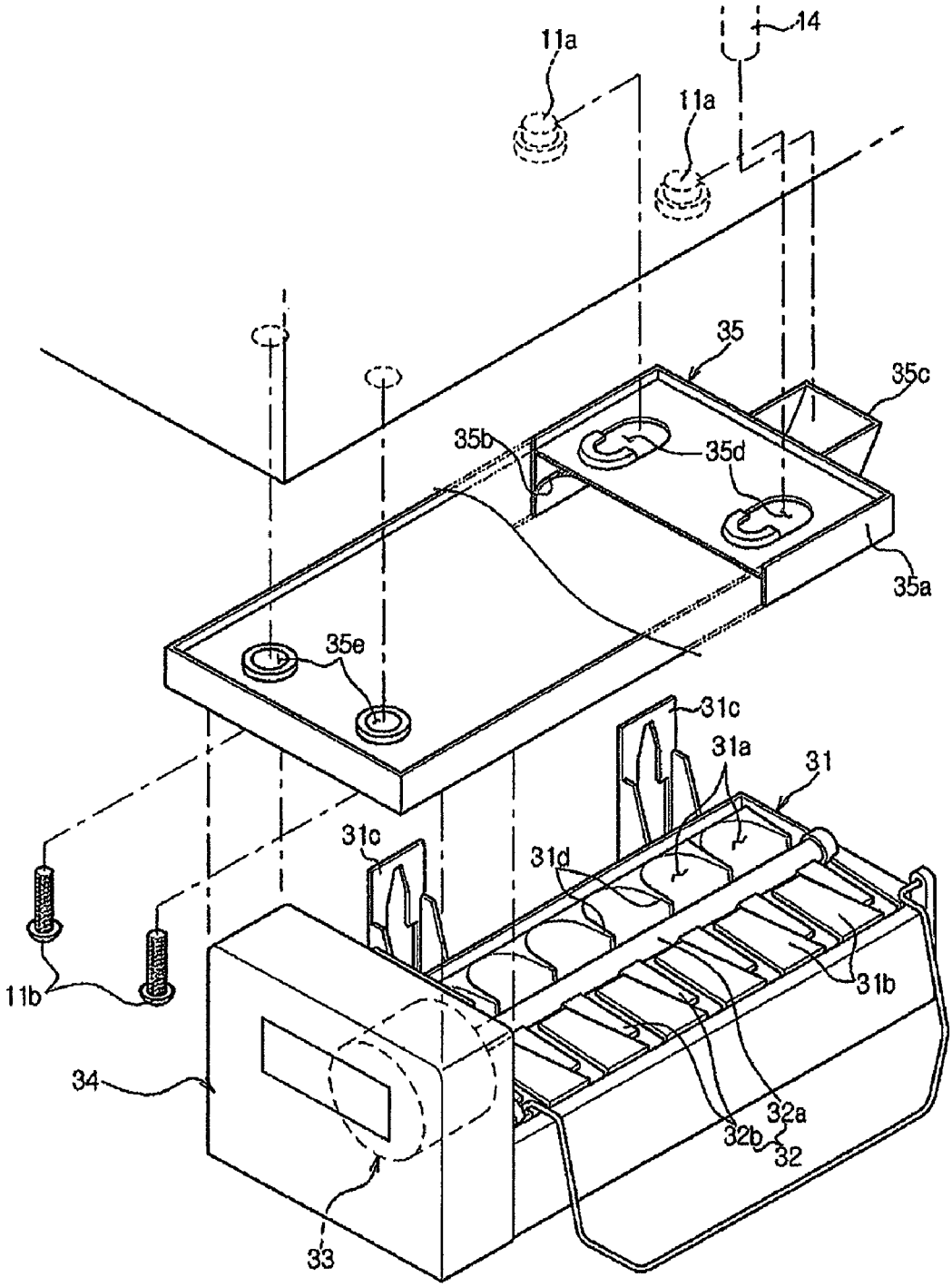
FIG. 2 illustrates an exploded perspective view showing a mounting structure of the ice making device applied to the refrigerator according to an embodiment of the present invention.

As shown in FIG. 2, the ice making device 30 includes an ice making tray 31 which is supplied with water to make ice, and an ejector 32 which is rotatably installed and separates the ice made in the ice making tray 31 from the ice making tray 31. The ice making device 30 further includes a driving motor 33 which is installed at one end in the longitudinal direction of the ejector 32 to rotate the ejector 32, and a driving case 34 which is installed at one side of the ice making tray 31 to have the driving motor 33 therein. The ice making device 30 further includes a fixing bracket 35 which is installed on an upper surface of the storage chamber 11, wherein the ice making tray 31 and the driving case 34 are disposed under the fixing bracket 35, such that the ice making device 30 can be installed while hanging from the upper surface of the storage chamber 11. A water supply line 14 is disposed on the upper surface of the storage chamber 11 to supply water to the ice making tray 31.

The ice making tray 31 is formed to have a specified length and a specified width and is installed in the storage chamber 11 to be extended in a forward/backward direction. A number of ice making grooves 31*a* which are formed in an approximately semicircular shape with open upper portions are arranged side by side in the forward/backward direction in the ice making tray 31 such that water is supplied into the ice making grooves 31*a* to make ice. Blocking members 31*b* are disposed at one side of the ice making tray 31 to cover an upper portion of one side of the ice making tray 31. The blocking members 31*b* prevent the ice separated from the ice making grooves 31*a* from returning to the ice making grooves 31*a*, thereby guiding the ice to the ice supplying device 40 disposed therebelow. A pair of fixing parts 31*c* is formed at the other side of the ice making tray 31 to be extended upward and fixed to the fixing bracket 35 by fastening members such as screws such that the ice making tray 31 can be fixed to the fixing bracket 35. A number of separation ribs 31*d* which are formed to be extended from the side surface of the ice making tray 31 are arranged at specified intervals to separate the ice making grooves 31*a* from each other. Although not shown in the drawings, a heater (not shown) is disposed under the ice making tray 31 to easily separate the ice from the ice making tray 31 by applying heat to the ice making tray 31. Further, a water supply guide part 35*c* for guiding the water supplied through the water supply line 14 to the ice making grooves 31*a* is formed at a rear end of the ice making tray 31 to be protruded backward such that water is supplied into the ice making grooves 31*a* from the rear end side through the water supply guide part 35*c*. In this case, a front end of the ice making tray 31 is positioned at a relatively lower level than the rear end of the ice making tray 31. Accordingly, the water supplied into the ice making grooves 31*a* positioned at the rear side through the water supply guide part 35*c* can easily move to the ice making grooves 31*a* positioned at the front side.

The ejector 32 is disposed to be extended in the forward/backward direction and one end of the ejector 32 is connected to the driving motor 33. The ejector 32 includes a rotation shaft 32*a* which is rotated by the driving motor 33 and a number of ejector pins 32*b* which are extended outward in a radial direction from the rotation shaft 32*a* and are rotated to move the ice made in the ice making grooves 31*a* upward from the ice making tray 31 along the inner semicircular surfaces of the ice making grooves 31*a*, thereby separating the ice from the ice making tray 31.

The driving case 34 is formed in an approximately rectangular box shape. An upper portion of the driving case 34 is fixedly installed on a lower portion of the fixing bracket 35. The driving motor 33 is installed inside the driving case 34. The driving case 34 is installed at the front side of the ice making tray 31 such that the driving motor 33 disposed in the driving case 34 can rotate the ejector 32.

The fixing bracket 35 is formed to have a specified area corresponding to the ice making tray 31 and the driving case 34 and is fixedly installed on the upper surface of the storage chamber 11. A rib portion 35*a* is formed at a periphery of the fixing bracket 35 to be extended in up and down directions for installation of the ice making tray 31 and the driving case 34.

Further, in order to install the fixing bracket 35 with the ice making tray 31 and the driving case 34 disposed under the fixing bracket 35, supporting protrusions 11*a* are formed on the upper surface of the storage chamber 11 to be protruded downward, and supporting holes 35*d* are disposed at a rear end portion of the fixing bracket 35. Accordingly, the supporting protrusions 11*a* are inserted into the supporting holes 35*d* and the supporting protrusions 11*a* are hooked by adjacent portions of the supporting holes 35*d*. Further, in order to stably maintain a state where the supporting protrusions 11*a* are supported by the adjacent portions of the supporting holes 35*d*, fastening holes 35*e* are disposed on a front end portion of the fixing bracket 35, and fastening members 11*b* such as screws are fixed to the upper surface of the storage chamber 11 through the fastening holes 35*e*. Thus, the fixing bracket 35 can be fixedly installed on the upper surface of the storage chamber 11 in a hanging state.

Figure 3:
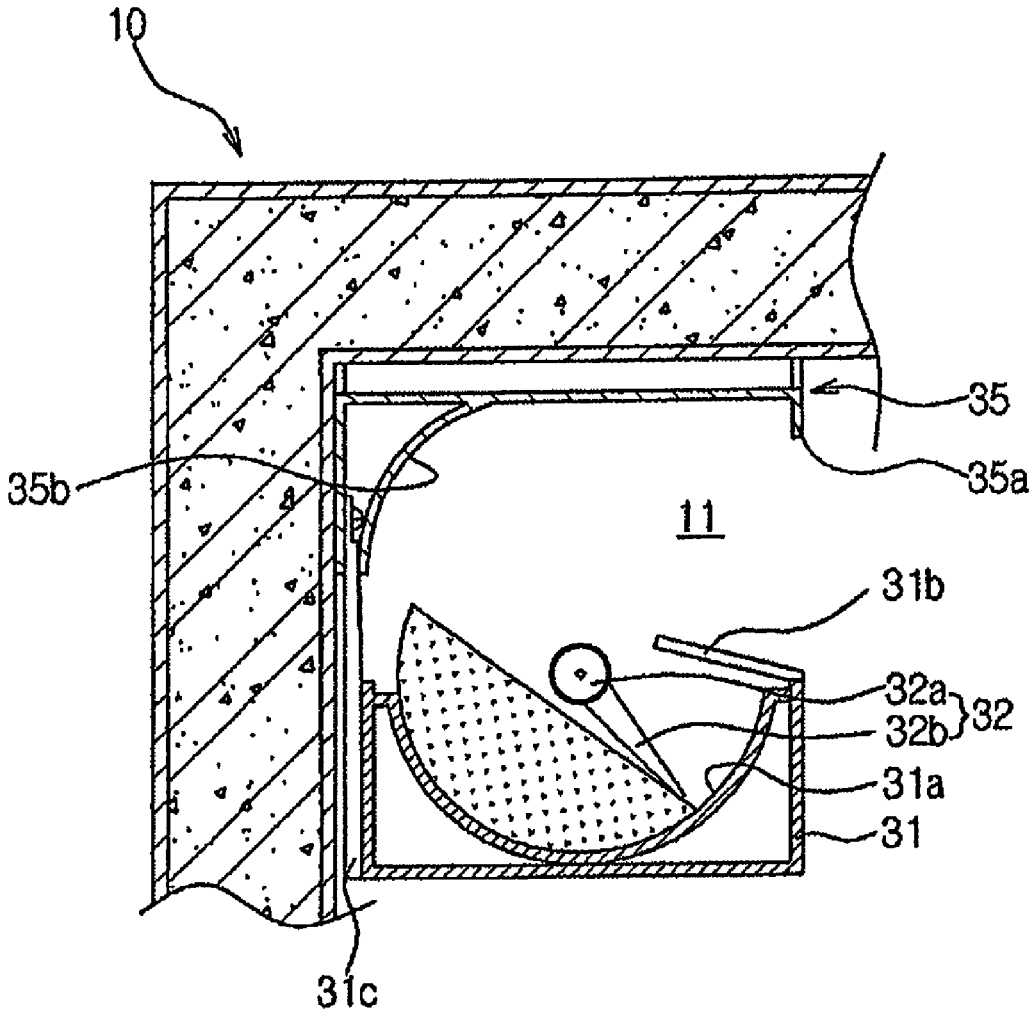
FIGS. 3 and 4 illustrate cross-sectional views showing an operation state of the ice making device applied to the refrigerator according to an embodiment of the present invention.
Figure 4:
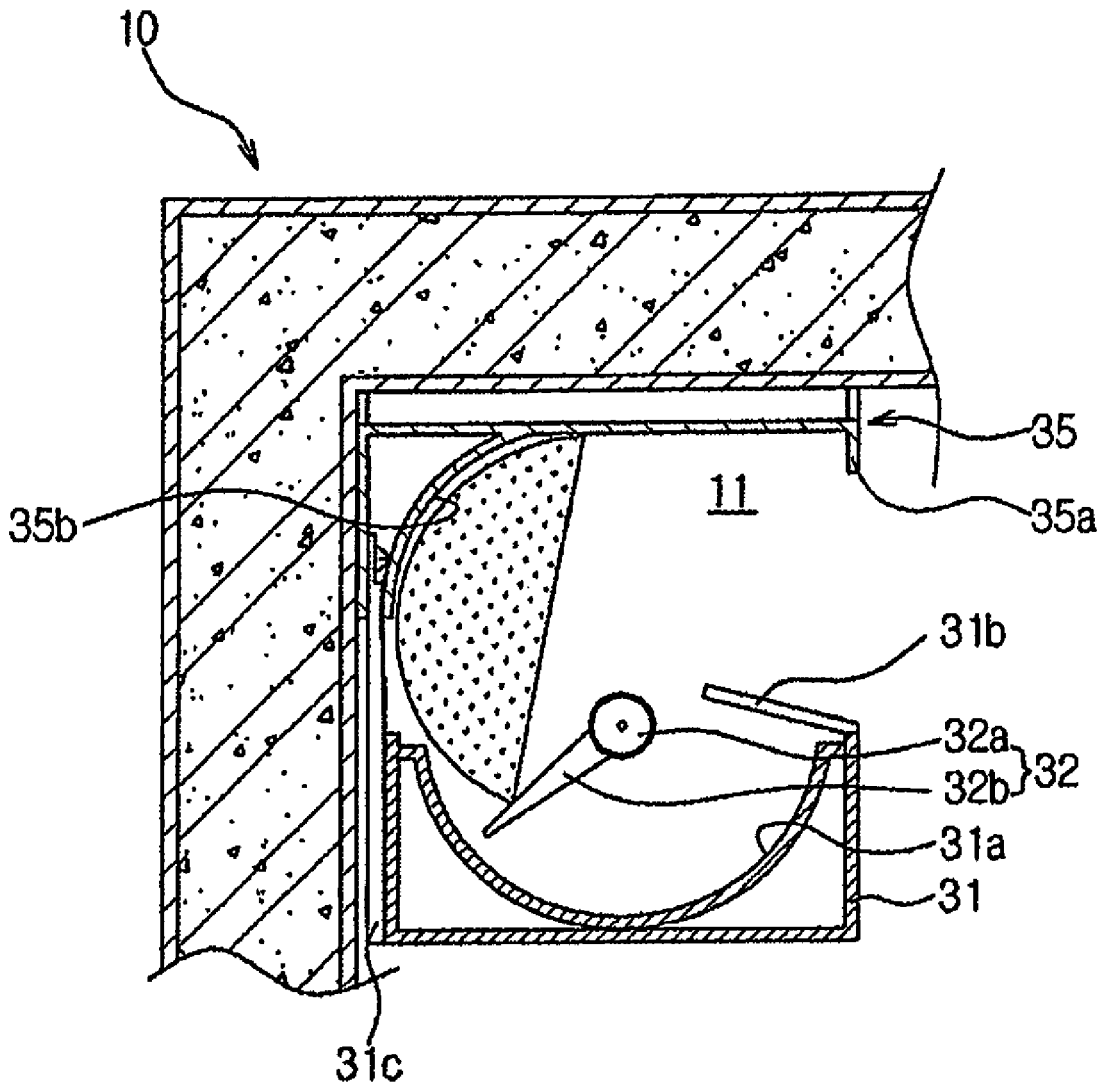

Further, the refrigerator according to the present invention further includes guidance members 31*b*, 35*b* that include a guide member 35*b* in order to prevent the ice from being inserted between the ejector 32 and the fixing bracket 35 while the ice is separated from the ice making grooves 31*a* by the ejector 32. The guide member 35*b* is formed above the other side of the ice making tray 31 with the blocking members 31*b* disposed at one side of the ice making tray 31 to be extended to have a length corresponding to that of the ice making tray 31. The guide member 35*b* guides the ice separated from the ice making grooves 31*a* through the other side of the ice making tray 31 toward the blocking members 31*b*. In this embodiment, the guide member 35*b* and the fixing bracket 35 are formed as a single body. The guide member 35*b* is formed outward in the radial direction of the ejector 32 to have a convex arc-shaped cross-section. Thus, as shown in FIG. 3, when the ejector 32 rotates for separation of the ice to apply a force to the ice made in the ice making grooves 31*a*, the ice is rotated and separated from the ice making grooves 31*a* through the other side of the ice making tray 31. Then, the ice is projected upward from the ice making tray 31. As shown in FIG. 4, an upper end of the ice moved upward is in contact with a lower surface of the guide member 35*b* having an arc-shaped cross-section. Then, the lower surface of the guide member 35*b* guides the ice toward the blocking members 31*b* disposed at one side of the ice making tray 31. Accordingly, the ice separated from the ice making grooves 31*a* is prevented from being inserted between the ejector 32 and the fixing bracket 35.

Figure 5:
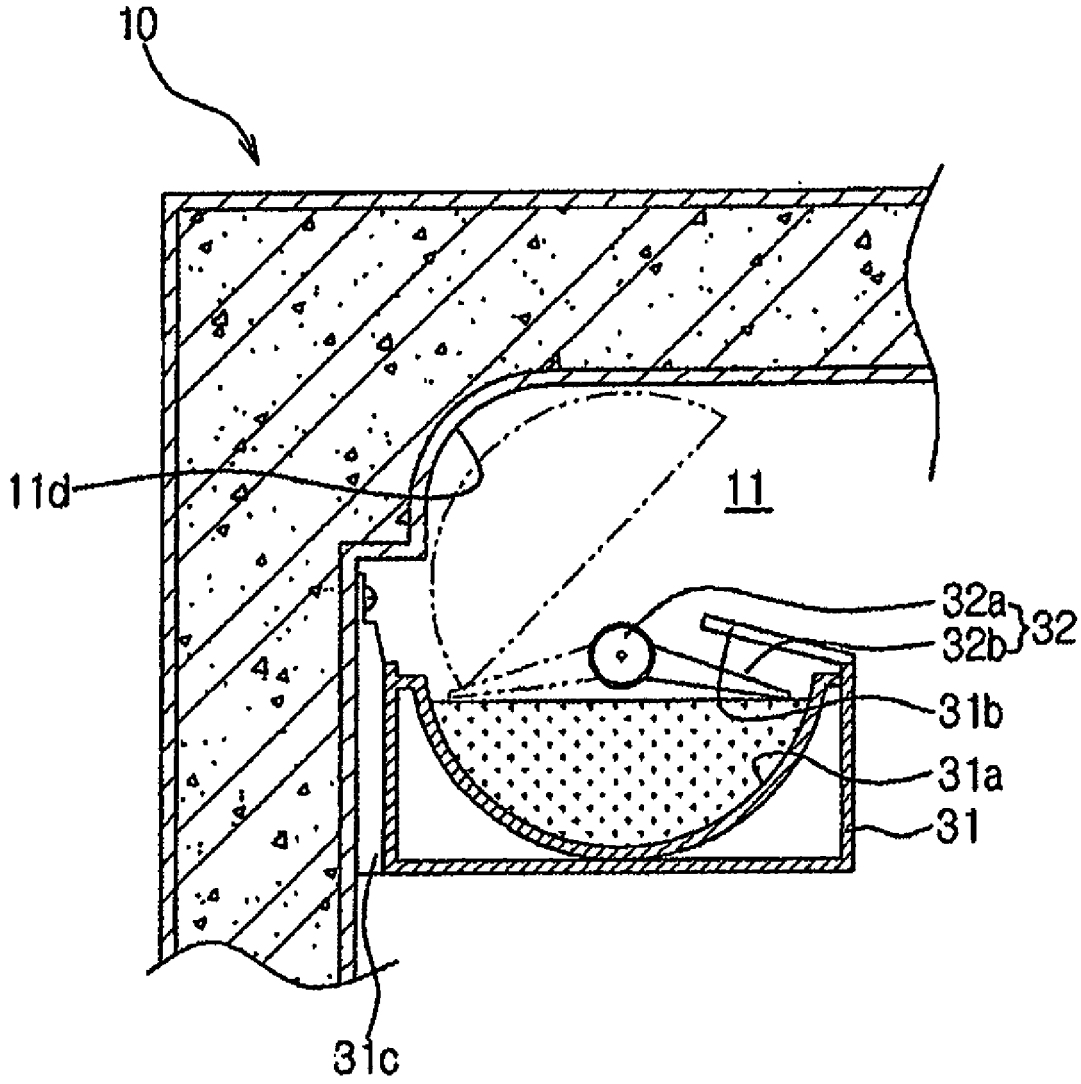
FIG. 5 illustrates a cross-sectional view showing a mounting structure of an ice making device applied to a refrigerator according to another embodiment of the present invention.

Although the ice making device 30 includes the fixing bracket 35 and the guide member 35*b* formed at the lower side of the fixing bracket 35 as a single body with the fixing bracket 35 in the above embodiment, the present invention is not limited thereto. That is, as shown in FIG. 5, a guide member 11*d* may be formed as a single body with an inner surface of the storage chamber 11.

Further, although the guide member 35*b* is formed to have an arc-shaped cross-section in the above embodiment, the present invention is not limited thereto. That is, the guide member 35*b* may be formed in various shapes capable of guiding the ice from an upper portion of the other side of the ice making tray 31 toward an upper portion of one side of the ice making tray 31.

As described above, in the refrigerator according to the present invention, the guide member is formed above the ice making tray to guide the ice separated from the ice making grooves by the ejector. Thus, it is possible to prevent the ice from being inserted between the ejector and the fixing bracket.

Further, according to the refrigerator of the present invention, even though there is a small space between an upper surface of the ice making tray and a lower surface of the fixing bracket, the ice separated from the ice making grooves is guided by the guide member, thereby preventing the ice from being inserted between the ejector and the fixing bracket. Thus, in an embodiment, the present invention includes a compact ice making device that has a small distance between the fixing bracket and the ice making tray.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a main body which forms an external appearance and has a storage chamber to be opened at a front side;

an ice making unit which is disposed in the storage chamber of the main body to make ice, the ice making unit including an ice making tray which has ice making grooves for making ice, an ejector which rotates about an axis to separate the ice made in the ice making grooves, and blocking members which are disposed at an upper portion of one side of the ice making grooves of the ice making tray to prevent the ice separated from the ice making grooves from returning to the ice making tray;

a parallelepiped guide member installed directly on the ceiling of the storage chamber, the guide member disposed above the ice making unit and extends over the axis of the ejector to make direct contact with and guide the ice separated from the ice making grooves by the ejector toward the blocking members, wherein, during manufacturing of the refrigerator, an installation of the guide member is performed separately from an installation of the ice making unit, as two independent installation processes.

2. The refrigerator according to claim 1, wherein the ice making unit further includes a fixing bracket with the ice making tray installed under the fixing bracket such that the ice making tray is installed while hanging from an upper surface of the storage chamber of the refrigerator, and the guide member is formed at a lower portion of the fixing bracket as a single body with the fixing bracket.

3. The refrigerator according to claim 1, wherein the guide member is formed outward in a radial direction of the ejector to have a convex arc-shaped cross-section.

4. An ice making device comprising:

an ice making tray which has ice making grooves for making ice;

an ejector coupled to the ice making tray, which rotates about an axis and separates the ice made in the ice making grooves;

blocking members which are disposed at one side of the ice making tray to prevent the ice separated from the ice making grooves from returning to the ice making grooves; and a parallelepiped guide member installed directly on the ceiling of the storage chamber above the ice making tray and extends over the axis of the ejector to make direct contact with and guide the ice separated from the ice making grooves by the ejector toward the blocking members, wherein the guide member and the ice making tray are adapted for separate installation to a refrigerator.

5. The ice making device according to claim 4, further comprising a fixing bracket with the ice making tray installed under the fixing bracket such that the ice making tray is installed while hanging from an upper surface of a storage chamber of a refrigerator, wherein the guide member is formed at a lower portion of the fixing bracket as a single body with the fixing bracket.

6. The ice making device according to claim 4, wherein the guide member is formed to have a convex arc-shaped cross-section in an outward direction.

7. A refrigerator comprising:

a body which forms an external appearance and has a storage chamber;

a door movably attached to the body to open and close the storage chamber;

an ice making unit installed in the storage chamber of the main body to make ice, the ice making unit including an ice making tray which has ice making grooves for making ice, an ejector coupled to the ice making tray which rotates about an axis to separate the ice made in the ice making grooves, blocking members which are disposed at an upper portion of one side of the ice making grooves of the ice making tray to prevent the ice separated from the ice making grooves from returning to the ice making grooves; and a guide portion provided at the storage chamber above the ice making unit and extends over the axis of the ejector to guide the ice separated from the ice making grooves by the ejector toward the blocking members, wherein the ice making unit is installed independently with respect to the guide portion, wherein the guide portion is immediately adjacent a flat ceiling portion of the storage chamber before installation of the ice making unit, wherein the guide portion includes a curved section that makes direct physical contact with the ice separated by the ejector during operation of the ice making unit.

8. The refrigerator according to claim 7, wherein the guide portion comprises a guide member installed directly on a ceiling of the storage chamber above the ice making tray and extends over the axis of the ejector to make direct contact with and guide the ice separated from the ice making grooves by the ejector toward the blocking members.

9. The refrigerator according to claim 7, wherein the guide portion is defined by an inner shell portion of the storage chamber, which includes the curved section shaped to guide the ice separated from the ice making grooves to move in a same direction as a rotation direction of the ejector, enabling the rotated ice to land on top of the blocking member.

* * * * *